US009743481B2

(12) United States Patent
Valenti

(10) Patent No.: US 9,743,481 B2
(45) Date of Patent: Aug. 22, 2017

(54) INDEPENDENTLY PROGRAMMABLE LIGHTS FOR USE IN GLOVES

(71) Applicant: Emazing Lights, LLC, West Covina, CA (US)

(72) Inventor: Richard J. Valenti, Palatine Bridge, NY (US)

(73) Assignee: EMAZING LIGHTS, LLC, Anaheim, CA (US)

( * ) Notice: Subject to any disclaimer, the term of this patent is extended or adjusted under 35 U.S.C. 154(b) by 0 days.

(21) Appl. No.: 14/868,244

(22) Filed: Sep. 28, 2015

(65) Prior Publication Data

US 2016/0021709 A1 Jan. 21, 2016

Related U.S. Application Data

(63) Continuation of application No. 13/747,220, filed on Jan. 22, 2013, now Pat. No. 9,148,931.

(60) Provisional application No. 61/596,273, filed on Feb. 8, 2012.

(51) Int. Cl.
*H05B 37/02* (2006.01)
*H05B 33/08* (2006.01)

(52) U.S. Cl.
CPC ..... *H05B 33/086* (2013.01); *H05B 33/0857* (2013.01); *H05B 37/02* (2013.01); *H05B 37/029* (2013.01); *H05B 37/0245* (2013.01)

(58) Field of Classification Search
None
See application file for complete search history.

(56) References Cited

U.S. PATENT DOCUMENTS

| | | | | |
|---|---|---|---|---|
| 3,359,411 | A | 12/1967 | Schwartz | |
| 4,524,409 | A | 6/1985 | Yakubek | |
| 5,124,892 | A | 6/1992 | Lambert | |
| 5,158,356 | A | 10/1992 | Guthrie | |
| 5,283,722 | A | 2/1994 | Koenen et al. | |
| 5,535,105 | A | 7/1996 | Koenen et al. | |
| 5,616,140 | A * | 4/1997 | Prescott | 606/10 |
| 5,632,548 | A | 5/1997 | Mayfarth | |

(Continued)

OTHER PUBLICATIONS

Infiny Gloves—Into The Light: [PM]Brainwreck [Mystery-Lights.com]; YouTube, uploaded on Jan. 18, 2012, https://www.youtube.com/watch?v=MwuA8C9zwLo;.

(Continued)

*Primary Examiner* — Cassandra Cox
(74) *Attorney, Agent, or Firm* — Klein, O'Neill & Singh, LLP

(57) ABSTRACT

The present invention extends to independently programmable lights for use in gloves and to gloves that incorporate such lights. Each independently programmable light of the present invention can include a programmable controller that stores logic for controlling the light such as by changing the color emitted by the light or the on/off pattern of the light. The user of the glove can modify the logic within the programmable controller to customize the functionality of the light. These modifications can be made by connecting the programmable light or a dedicated control unit that connects to each programmable light to another computer system to transfer new or updated logic to a programmable controller for controlling the lights in a custom manner.

34 Claims, 10 Drawing Sheets

(56) References Cited

U.S. PATENT DOCUMENTS

| | | | | |
|---|---|---|---|---|
| 6,039,454 | A | 3/2000 | Hallgrimsson | |
| 6,454,435 | B1 | 9/2002 | Altman | |
| 6,530,672 | B2 | 3/2003 | Galli | |
| 6,709,142 | B2 | 3/2004 | Gyori | |
| 6,860,896 | B2 * | 3/2005 | Leber et al. | 607/1 |
| 6,892,397 | B2 | 5/2005 | Raz et al. | |
| 6,902,289 | B1 | 6/2005 | Smith | |
| 6,975,079 | B2 | 12/2005 | Lys et al. | |
| 7,036,740 | B2 | 5/2006 | Waters | |
| 7,038,399 | B2 | 5/2006 | Lys et al. | |
| 7,064,498 | B2 | 6/2006 | Dowling et al. | |
| 7,161,556 | B2 | 1/2007 | Morgan et al. | |
| 7,186,003 | B2 | 3/2007 | Dowling et al. | |
| 7,550,935 | B2 | 6/2009 | Lys et al. | |
| 7,649,323 | B1 | 1/2010 | Kuhlmann et al. | |
| 8,376,565 | B2 | 2/2013 | Schrimmer et al. | |
| 2001/0004808 | A1 * | 6/2001 | Hurwitz | 36/137 |
| 2002/0089845 | A1 | 7/2002 | Altman | |
| 2002/0112734 | A1 | 8/2002 | Rambeau et al. | |
| 2005/0018419 | A1 | 1/2005 | Parsons | |
| 2006/0007669 | A1 | 1/2006 | Blackburn | |
| 2006/0092624 | A1 | 5/2006 | Park | |
| 2006/0125806 | A1 | 6/2006 | Voyles et al. | |
| 2007/0295349 | A1 | 12/2007 | Simpson | |
| 2009/0293896 | A1 | 12/2009 | Simpson | |
| 2012/0069552 | A1 | 3/2012 | Richter | |
| 2012/0081884 | A1 | 4/2012 | Gonzalez | |
| 2012/0081885 | A1 | 4/2012 | Schrimmer et al. | |

OTHER PUBLICATIONS

"Infiny Gloves—Mode Demonstration & Case Comparisons", YouTube, uploaded on Jan. 21, 2012, https://www.youtube.com/watch?v=A3rW9kXxKDw.

ThingM Smart Devices Made Simple, BlinkM, http://thingm.com/products/blinkm/.

U.S. Appl. No. 13/747,220, filed Jan. 22, 2013, Richard J. Valenti Blink v1 Datasheet v20080130a, pp. 1-126.

Emazing Lights, LLC v. Ramiro Montes De Oca and Quantum Hex LLC (Case No. 8:15-cv-01561-AG-E): Defendants Ramiro Montes De Oca and Quantum Hex, LLC's Answer to Plaintiff Emazing Lights, LLC's First Amended Complaints and Counterclaims, dated Feb. 19, 2016.

* cited by examiner

INDEPENDENTLY PROGRAMMABLE LIGHTS FOR USE IN GLOVES

RELATED APPLICATION

This application is a continuation of U.S. application Ser. No. 13/747,220, filed Jan. 22, 2013, which claims priority to U.S. Provisional Patent Application No. 61/596,273, filed Feb. 8, 2012, entitled MULTI FUNCTIONAL PROGRAMMABLE MULTI LIGHT EFFECT EMITTING GLOVE AND GLOVE INSERT WITH REMOVABLE PROGRAMMABLE MICRO LIGHT AND FINGER LIGHT ATTACHMENTS. The entirety of each of these priority applications is hereby incorporated by reference.

BACKGROUND OF THE INVENTION

Gloving is a term that refers to the art of performing a lightshow using gloves that include a light in each finger. FIG. 1 illustrates an exemplary glove 100 that can be used for gloving. As shown, glove 100 includes lights 101*a*-101*e* at the tip of each finger and thumb. Generally, a glover will wear gloves 100 on each hand and move his hands with the beat of music to perform a lightshow.

Previous gloves used for gloving have generally employed basic single color, single mode LEDs. More complex gloves have also been used which include multicolor, multiple mode LEDs. For example, some existing gloves can include a switch or other control to change one or more of the LEDs from a first mode providing a first light pattern to a second mode providing a second light pattern.

Although these more complex gloves enable more variety in a gloving performance, the glover is still limited to the preconfigured modes of operation for each light. Accordingly, these existing gloves have not allowed the glover to customize the functionality of the lights to his liking.

BRIEF SUMMARY OF THE INVENTION

The present invention extends to independently programmable lights for use in gloves and to gloves that incorporate such lights. Each independently programmable light of the present invention can include a programmable controller that stores logic for controlling the light such as by changing the color emitted by the light or the on/off pattern of the light. The user of the glove can modify the logic within the programmable controller to customize the functionality of the light.

In one embodiment, a gloving light comprises a case that is configured to be attached to a finger of a glove. The case includes an LED, a programmable controller storing logic for controlling the functionality of the LED, and an interface for modifying the logic stored in the programmable controller.

In another embodiment, the invention comprises a light set for use with a glove to perform gloving. The light set includes one or more programmable lights. Each programmable light comprises a case that is configured to attach to a fingertip of a glove. The case includes an LED.

The light set also includes a dedicated control unit for controlling each of the one or more programmable lights. The dedicated control unit is configured to attach to the glove and includes a programmable controller storing logic for controlling the functionality of the LED in each of the one or more programmable lights, and an interface for modifying the logic stored in the programmable controller.

The light set also includes one or more wires for connecting the dedicated control unit to the one or more programmable lights when the dedicated control unit and the one or more programmable lights are attached to the glove.

In another embodiment, the present invention comprises a method for transferring logic to a programmable controller for controlling one or more programmable lights attached to a glove used for gloving. Representations are displayed for a plurality of light effects that can be implemented using programmable lights on a glove used for gloving. A user selection of one of the plurality of representations is received. A connection is established with a programmable controller for controlling one or more programmable lights on a glove used for gloving. Logic is then transferred to the programmable controller. The logic, when executed by the programmable controller, causes the programmable controller to output a signal for controlling the one or more programmable lights to implement the light effect of the selected representation.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

The present invention extends to independently programmable lights for use in gloves and to gloves that incorporate such lights. Each independently programmable light of the present invention can include a programmable controller that stores logic for controlling the light such as by changing the color emitted by the light or the on/off pattern of the light. The user of the glove can modify the logic within the programmable controller to customize the functionality of the light.

In one embodiment, a gloving light comprises a case that is configured to be attached to a finger of a glove. The case includes an LED, a programmable controller storing logic for controlling the functionality of the LED, and an interface for modifying the logic stored in the programmable controller.

In another embodiment, the invention comprises a light set for use with a glove to perforin gloving. The light set includes one or more programmable lights. Each programmable light comprises a case that is configured to attach to a fingertip of a glove. The case includes an LED.

The light set also includes a dedicated control unit for controlling each of the one or more programmable lights. The dedicated control unit is configured to attach to the glove and includes a programmable controller storing logic for controlling the functionality of the LED in each of the one or more programmable lights, and an interface for modifying the logic stored in the programmable controller.

The light set also includes one or more wires for connecting the dedicated control unit to the one or more programmable lights when the dedicated control unit and the one or more programmable lights are attached to the glove.

In another embodiment, the present invention comprises a method for transferring logic to a programmable controller for controlling one or more programmable lights attached to a glove used for gloving. Representations are displayed for a plurality of light effects that can be implemented using programmable lights on a glove used for gloving. A user selection of one of the plurality of representations is received. A connection is established with a programmable controller for controlling one or more programmable lights on a glove used for gloving. Logic is then transferred to the programmable controller. The logic, when executed by the programmable controller, causes the programmable controller to output a signal for controlling the one or more programmable lights to implement the light effect of the selected representation.

Figure 1:
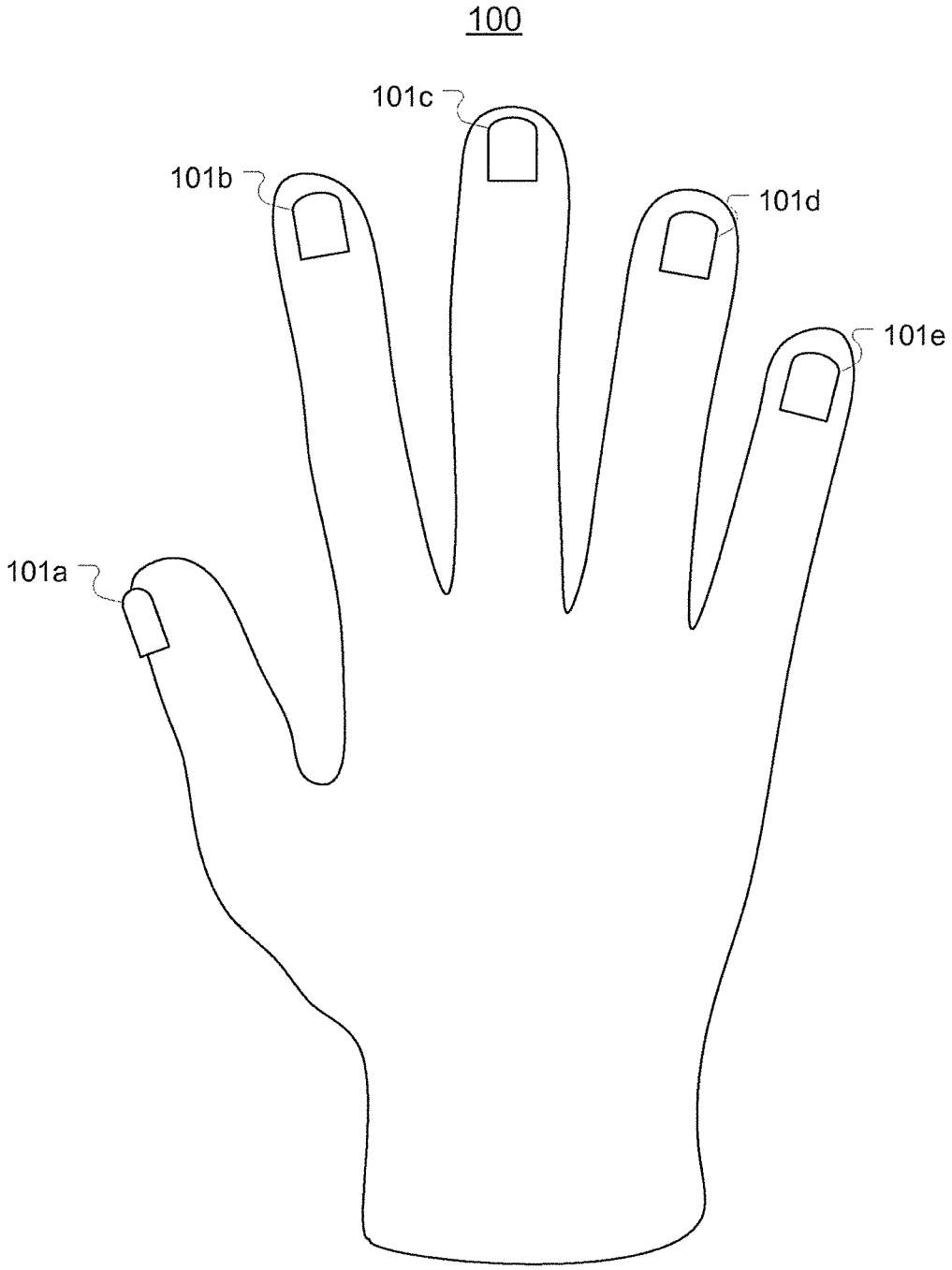
FIG. 1 illustrates an exemplary glove in which the programmable lights of the present invention could be used.
Figure 2:
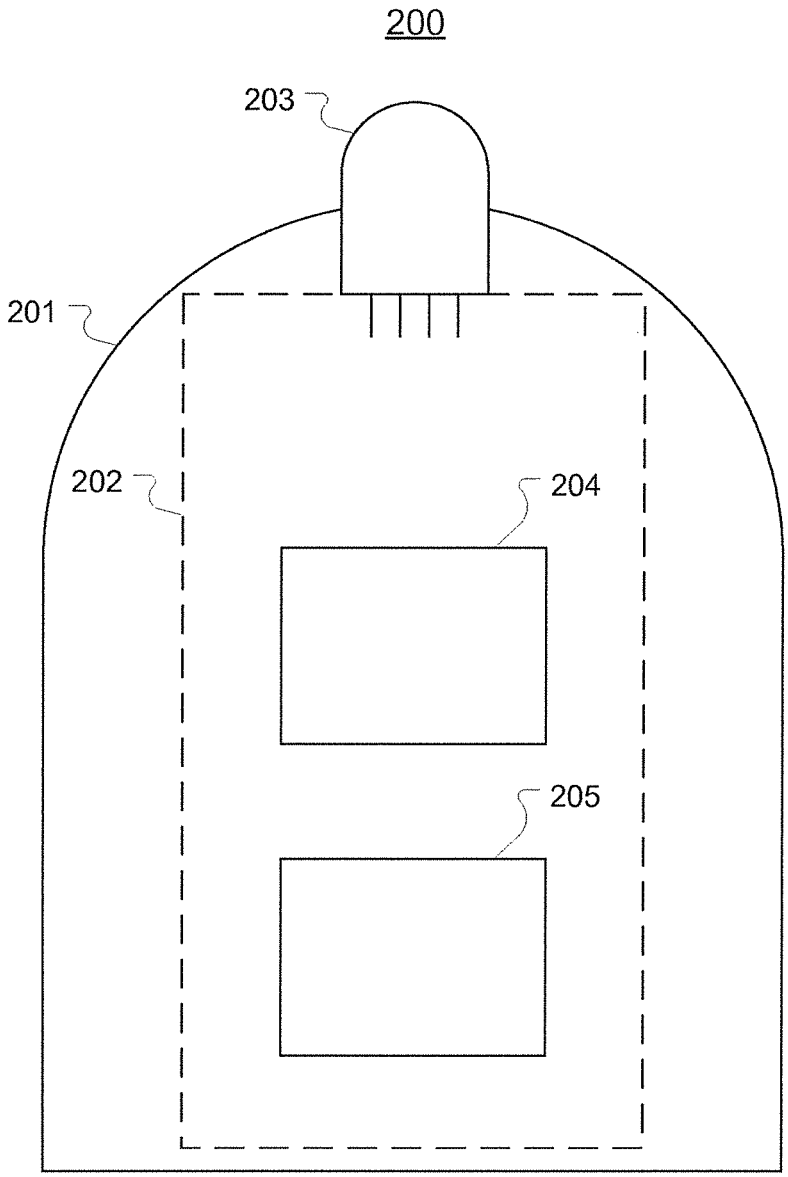
FIG. 2 illustrates an exemplary programmable light.

FIG. 2 illustrates an exemplary programmable light 200 according to one or more embodiments of the invention. Programmable light 200 can be used in place of any of lights 101*a*-101*e* shown in FIG. 1.

Programmable light 200 includes a case 201 for housing the components of the light. These components include a circuit board 202, an LED 203, a programmable controller 204 storing logic for controlling the functionality of the LED, and an interface 205 for modifying the logic stored in the programmable controller. Circuit board 202 should be construed as covering any means for interconnecting the other components of programmable light 200 including, but not limited to, commonly used printed circuits boards. Programmable light 200 may also include a battery for powering programmable controller 204. In some embodiments, however, an external power source may be used.

LED 203 can comprise any type of LED whose output can be varied by varying the voltage driving the LED. In this specification, LED 203 will be described as an RGB LED. An RGB LED is actually comprised of three separate LEDs: a red, a green, and a blue LED. An RGB LED can output virtually any color by varying the intensity of the red, green, and blue LEDs so that the appropriate mixture of colors and color intensities is output to yield the desired color. For example, to output purple, the green LED can be turned off while the red and blue LEDs are driven thereby outputting red and blue light that when mixed forms purple.

Each individual red, green, and blue LED in the RGB LED is driven by a voltage source. As shown in FIG. 2, LED 203 includes four leads, one lead for driving each LED and a common ground lead. By varying, the voltage on one of the three driving leads, the intensity of the color output by the corresponding individual LED can be varied. For example, using the same example above, a different shade of purple can be generated by varying the voltage driving the red and blue LEDs.

Programmable controller 204 stores logic for controlling the voltages that are applied to each of the three driving leads. For example, the logic can define a sequence or pattern of voltages that are output from programmable controller 204 to cause the RGB LED to output a certain sequence or pattern of colors. The logic stored within programmable controller 204 can be replaced or modified. In other words, programmable controller 204 may be programmed by the user. In this manner, a user can customize the functionality of LED 203 to produce virtually any desired sequence.

Interface 205 can represent any type of interface for accessing programmable controller 204 to modify the logic stored therein. For example, interface 205 can comprise a wired interface such as any of the hardware ports that are commonly found on mobile computing devices (e.g. a USB port), or can comprise a wireless interface such as a Wi-Fi, Bluetooth, infrared, or other wireless interface.

Interface 205 enables a user to communicate with programmable controller 204 using an external computing device. For example, if interface 205 is a USB interface, a USB cable can be used to connect programmable controller 204 to another computer system such as a dedicated control unit or a general computing device such as a user's mobile phone, tablet, laptop, or desktop computer. The user can use the other computing device to transfer (e.g. via the USB connection or other wired or wireless connection) new or updated logic to programmable controller 204 for driving LED 203 with a new or updated pattern.

Figure 3A:
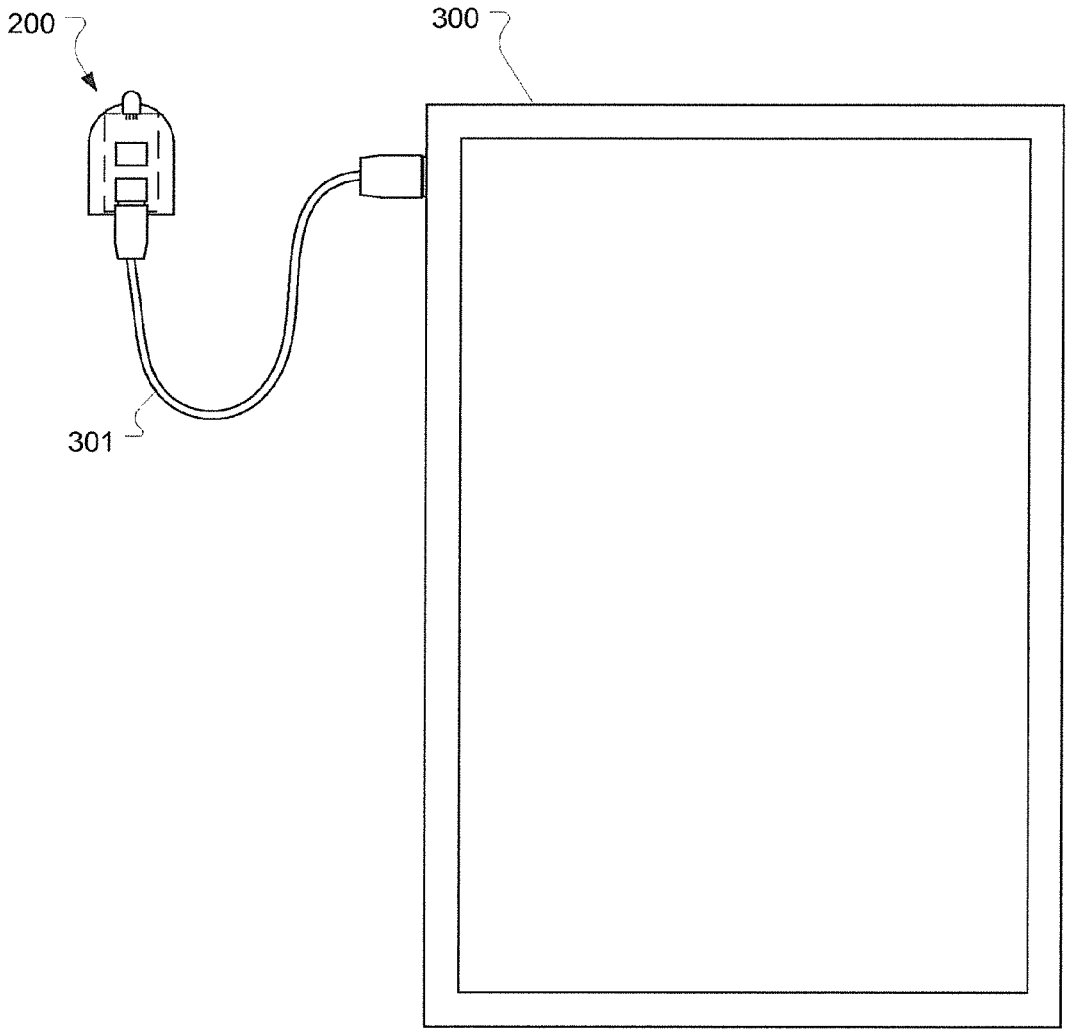
FIGS. 3A and 3B illustrate exemplary connections between a programmable light and a computing device.

FIG. 3A illustrates an embodiment where interface 205 comprises a USB port that is connected via a USB cable 301 directly to a general computing, device which in this case is shown as a tablet 300.

Figure 3B:
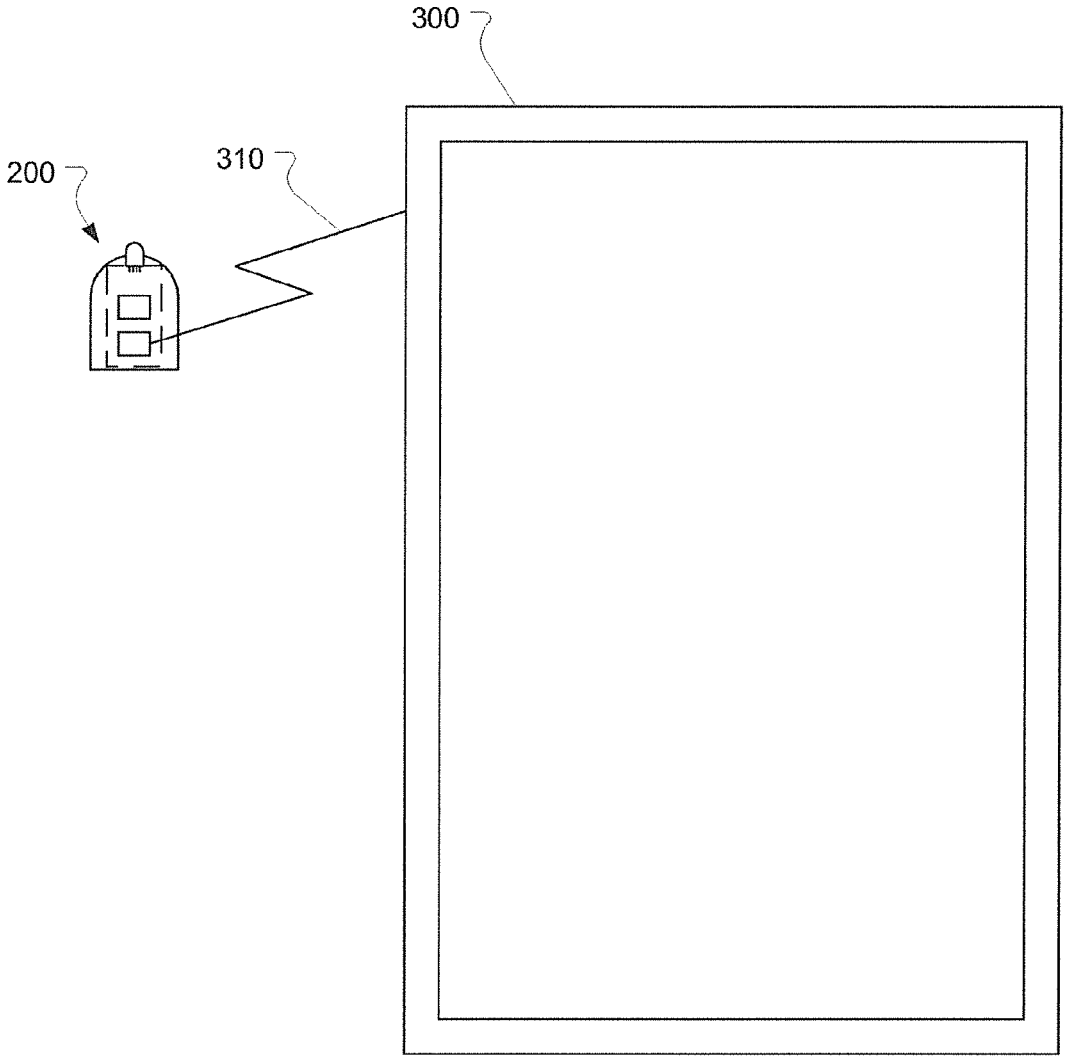

FIG. 3B illustrates an embodiment where interface 205 comprises a wireless interface such as a Bluetooth interface. As shown, a general computing device such as tablet 300 can wirelessly transfer logic to programmable controller 204 via a Bluetooth connection 310.

Figure 3C:
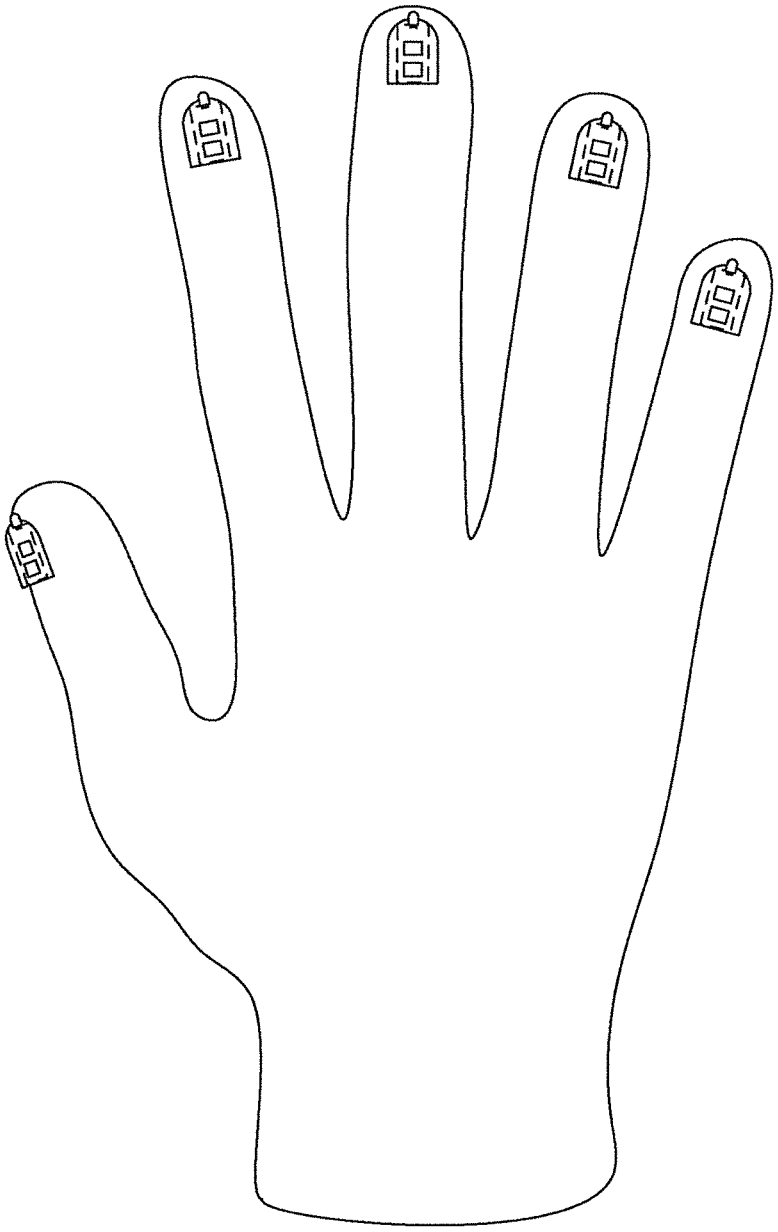
FIG. 3C illustrates a glove that includes the exemplary programmable lights of FIG. 2.

FIG. 3C illustrates a glove that includes programmable light 200 in each of the fingers and thumb. The glove can be configured so that each of programmable lights 200 can be independently attached and removed from the glove.

Figure 4A:
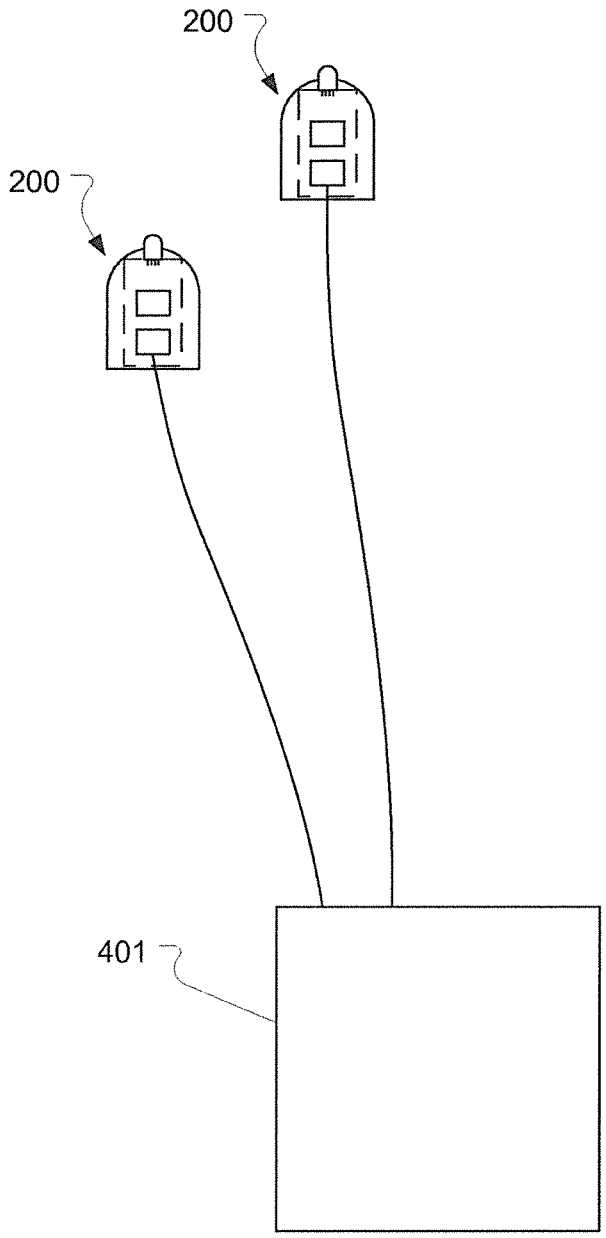
FIGS. 4A-4C illustrate a dedicated control unit that can be used to control a function of one or more programmable lights.

FIG. 4A illustrates an embodiment where a dedicated control unit 401 is used to transfer logic to programmable controller 204. This embodiment can be advantageous when dedicated control unit 401 is attached to, or worn in conjunction with, a glove as shown in FIG. 4B.

Figure 4B:
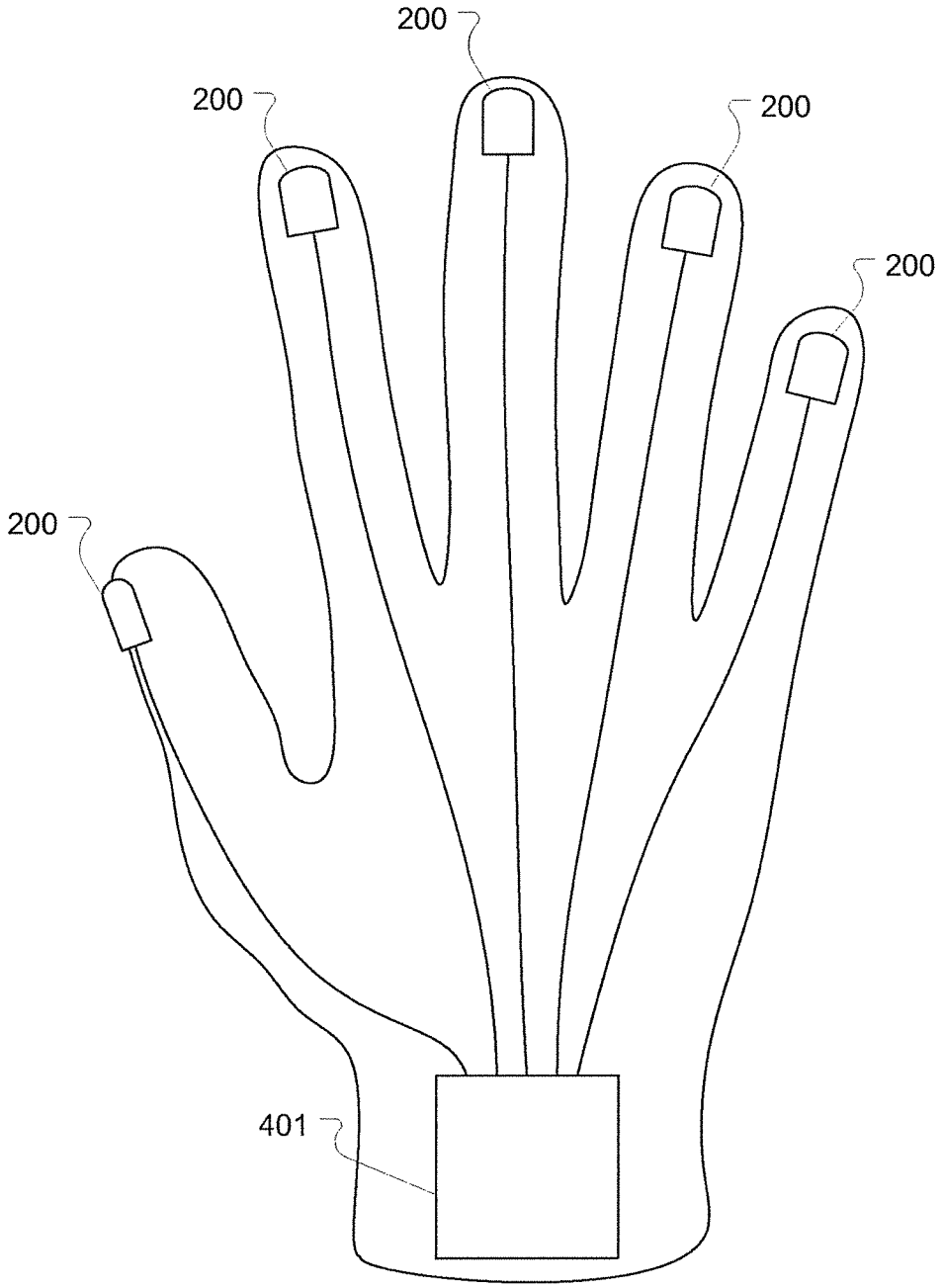

FIG. 4B illustrates that dedicated control unit 401 can be attached to a glove. In such embodiments, the glove can include wires connecting dedicated control unit 401 to each programmable light 200 to allow logic to be transferred from dedicated control unit 401 to the programmable controller 204 on each programmable light 200. These wires can be embedded in the glove or can be separate removable components.

For example, in some embodiments, a glove can include embedded wires that run from a housing for the dedicated control unit 401 to individual housings for each programmable light 200. These housings can be configured to allow the dedicated control unit 401 and programmable lights 200 to be inserted and removed as necessary.

When a dedicated control unit 401 is used, the programmable lights 200 of the present invention can also be implemented by placing programmable controller 204 on dedicated control unit 401 rather than within each programmable light 200. In other words, the voltages for driving each LED 203 can be generated by a programmable controller 204 on dedicated control unit 401 and output to each programmable light 200 over the depicted wires.

Figure 4C:
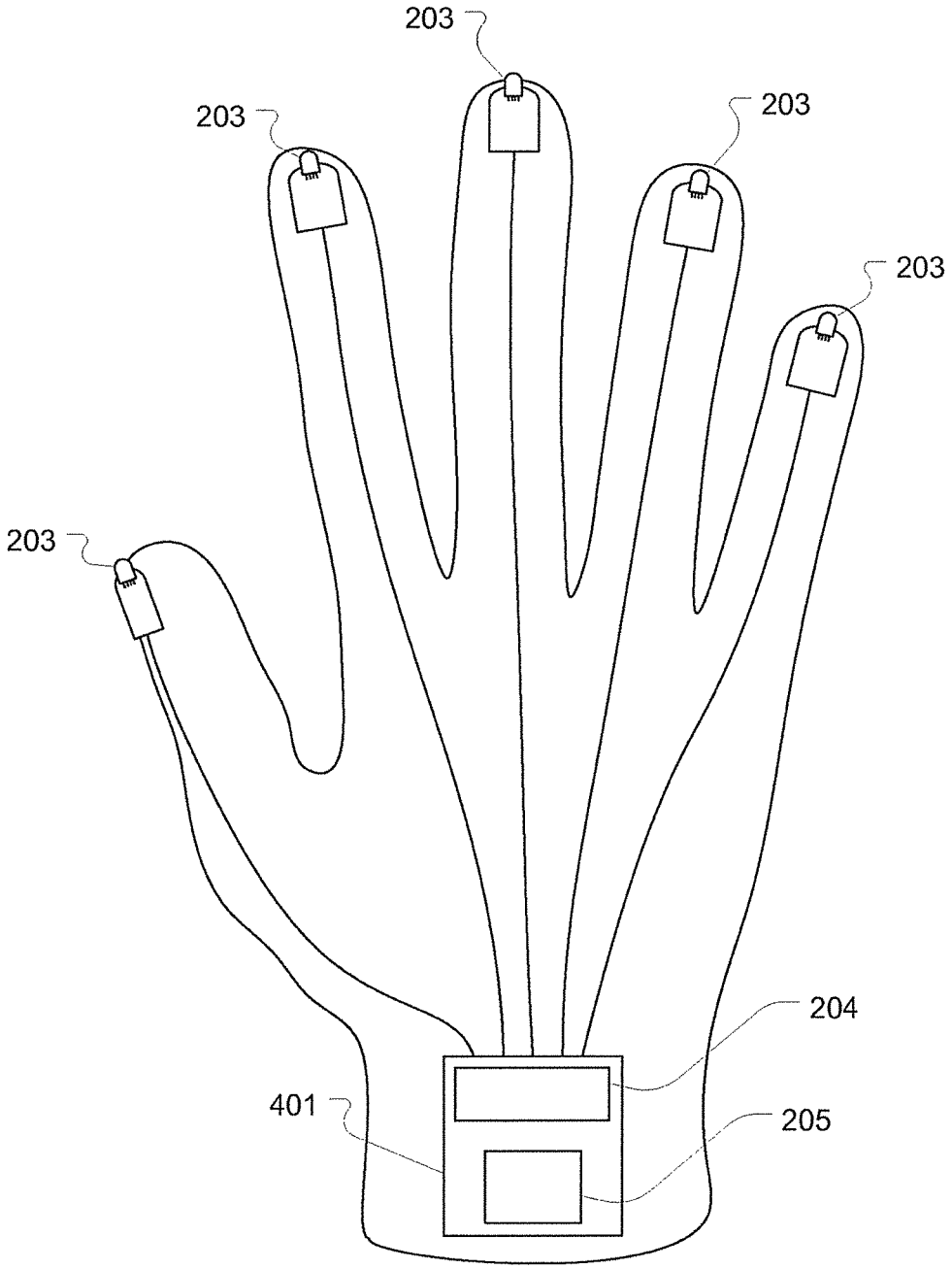

FIG. 4C illustrates an embodiment where a dedicated control unit 401 houses a programmable controller 204 and an interface 205 while each programmable light 200 includes an LED 203. In this embodiment, dedicated control unit 401 and each programmable light 200 can be removed from the glove. The wires interconnecting dedicated control unit 401 and each programmable light 200 may be embedded or attached to the glove and may be removable. As stated above, interface 205 can be used to connect dedicated control unit 401 to another computing device to allow the logic in programmable controller 204 to be reprogrammed. Also, the glove may be configured to allow dedicated control unit 401 and/or programmable lights 200 to be easily snapped in to connect the circuit.

Embodiments which employ a dedicated control unit 401 may be less advantageous because they require the added bulk of the dedicated control unit during use of the glove. However, in some cases, these embodiments may be preferred because it allows the programmable lights 200 to be simpler and less expensive (e.g. when the programmable lights comprise only an LED in a case with all other components being located on the dedicated control unit), and may facilitate the reprogramming of programmable controller 204 for some individuals (e.g. by allowing a single programmable controller 204 to be used to drive all five LEDs rather than requiring a programmable controller 204 for each LED).

As can be seen, a programmable light 200 can be implemented in many different ways in accordance with the present invention. As such, the invention should not be limited to any particular configuration or location of any specific component (e.g. whether within case 201 or on dedicated control unit 401). Instead, the invention encompasses all configurations which allow the addition of logic or modification of logic stored on a programmable controller 204 for driving one or more LEDs in a user customized manner.

Figure 5:
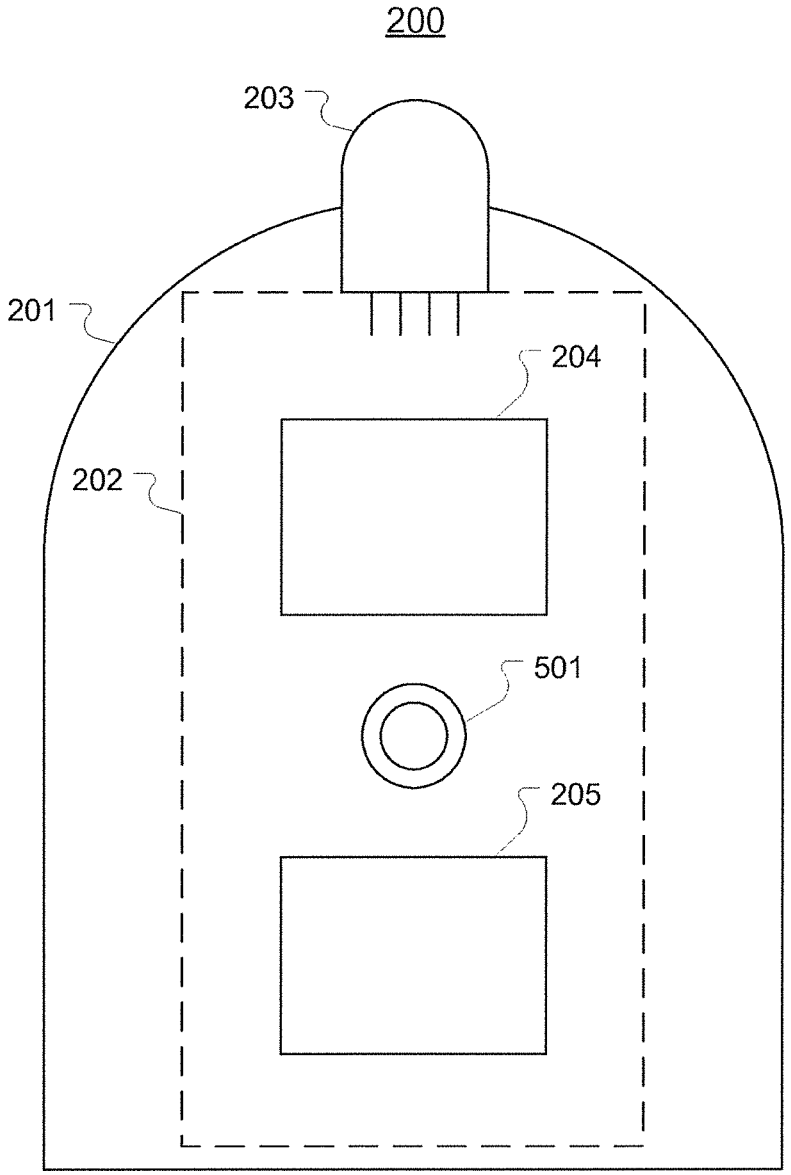
FIG. 5 illustrates an embodiment of a programmable light that includes a control button.

FIG. 5 illustrates an embodiment where programmable light 200 includes a control button 501. Control button 501 can provide access to the logic stored in programmable controller 204 to enable a user to modify a current operating mode of programmable light 200. For example, programmable controller 204 may store logic for outputting two or more different patterns. By actuating control button 501, the user can switch from one pattern to another.

It is noted that there is a difference between modifying a current operating mode of a programmable light and reprogramming the light. In the first case, the logic stored within the programmable light is not modified, whereas, in the second case, the logic is replaced or updated in some manner. In other words, a non-programmable controller may store logic for various operating modes from which the user can select. However, in such cases, the user does not have the option of adding a new mode to or modifying an existing mode on the non-programmable controller. In contrast, the present invention allows the user to add new modes, change existing modes, or otherwise modify the logic stored in reprogrammable controller 204 to generate custom LED output patterns.

Accordingly, the programmable lights 200 of the present invention can be programmable and can provide multiple modes of operation without requiring reprogramming. In this way, a user can program the programmable light 200 so that it has the capability to output multiple custom patterns.

The present invention also extends to an online repository of downloadable logic for controlling reprogrammable light 200. In a particular example, this online repository can be implemented as a webpage or a mobile app where a user can select particular patterns and download the logic for controlling the programmable controller 204 to output the selected patterns. When a pattern is selected, the logic for implementing the pattern can be downloaded to a user's computer system and transferred to the appropriate programmable controller 204 in any of the ways described above.

Additionally, in some embodiments, the webpage or mobile app can include functionality that allows the users to create their own patterns. For example, the webpage or app can provide an interface for defining desired colors and sequences for a particular programmable light. The webpage or app can include functionality for generating the necessary logic that can be downloaded and transferred to programmable controller 204 to implement the defined colors and sequences. In this way, the use can have complete freedom to implement any type of light effect for use while gloving.

Figure 6:
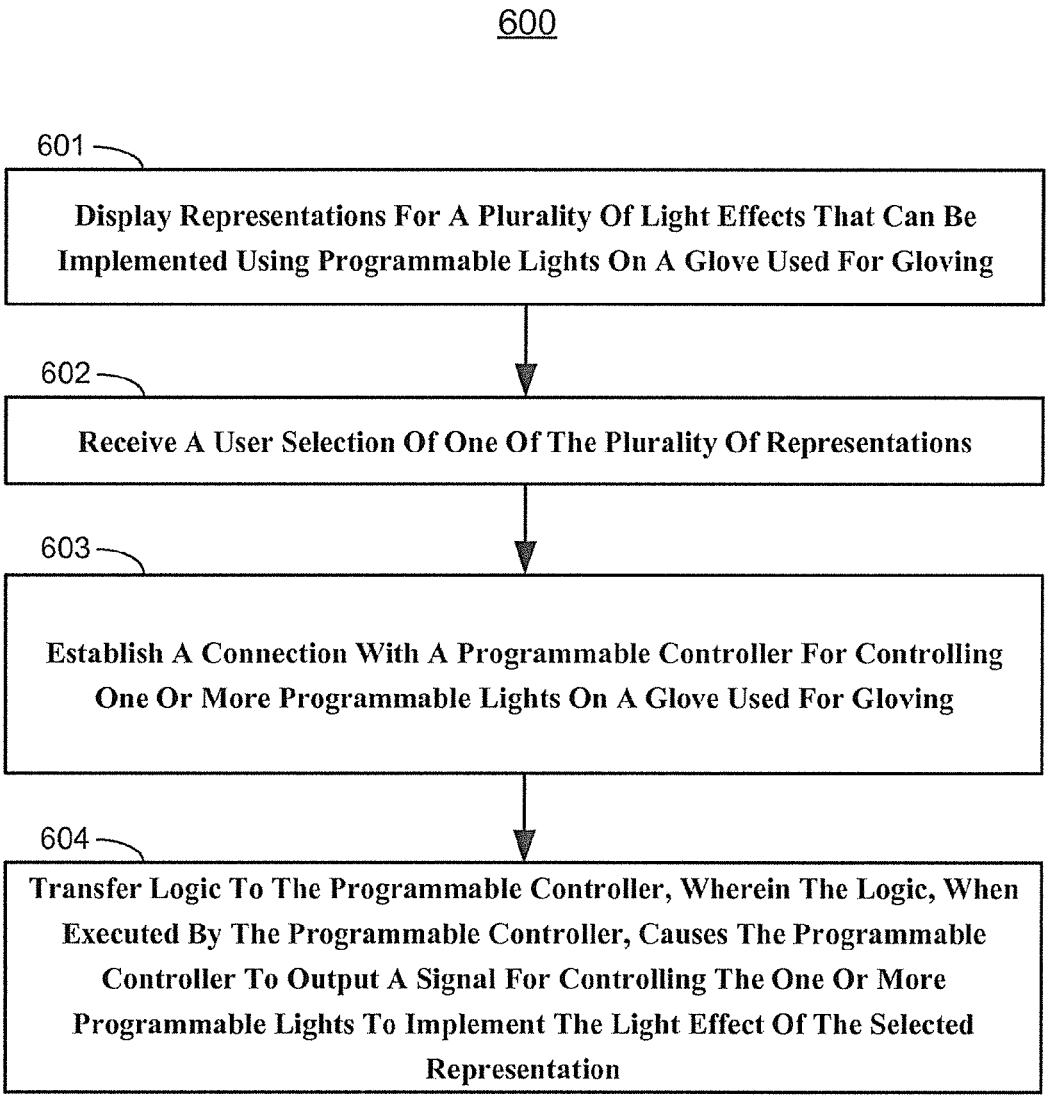
FIG. 6 illustrates a flowchart of an exemplary method for transferring logic to a programmable controller for controlling one or more programmable lights attached to a glove used for gloving.

FIG. 6 illustrates a flowchart of an exemplary method 600 for transferring logic to a programmable controller for controlling one or more programmable lights attached to a glove used for gloving. Method 600 will be described with reference to the figures.

Method 600 includes an act 601 of displaying representations for a plurality of light effects that can be implemented using programmable lights on a glove used for gloving. For example, a user can use a computing device such as tablet 300 to browse available light effects. The available light effects can be displayed in a webpage, an app, or any other way.

Method 600 includes an act 602 of receiving a user selection of one of the plurality of representations. For example, the user can select one of the representations being displayed within a webpage or app on tablet 300.

Method 600 includes an act 603 of establishing a connection with a programmable controller for controlling one or more programmable lights on a glove used for gloving. For example, a connection can be established between tablet 300 and programmable controller 204. This connection can be wired (e.g. USB) or wireless (e.g. Bluetooth).

Method 600 includes an act 604 of transferring logic to the programmable controller, wherein the logic, when executed by the programmable controller, causes the programmable controller to output a signal for controlling the one or more programmable lights to implement the light effect of the selected representation. For example, tablet 300 can transfer logic to programmable controller 204 to allow programmable controller 204 to control one or more of LEDs 203 to implement the light effect.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. A light set for use with a glove to perform gloving, the light set comprising:

a plurality of programmable lights, each of the programmable lights being sized and configured to be included in a finger of a glove, each programmable light comprising:

a case that is sized and configured to fit within a fingertip of a glove, the case including a multicolor light emitting diode (LED);

a programmable controller storing logic for controlling the functionality of the LED according to a plurality of operating modes, wherein in a first operating mode the programmable controller directs the LED to display a first light output pattern, and in a second operating mode the programmable controller directs the LED to display a second light output pattern;

a control button for changing from the first operating mode to the second operating mode; and an interface for modifying the logic stored in the programmable controller, the interface configured to establish communication between the programmable controller and an external computing device;

wherein each of the plurality of programmable lights can be removed from the glove independently of the others of the plurality of programmable lights; and wherein each of the plurality of programmable lights can be independently programmed.

2. The light set of claim 1, wherein in each of the programmable lights the interface comprises a USB interface.

3. The light set of claim 1, wherein the interface comprises a wireless interface.

4. A light set as in claim 1, wherein the external computing system comprises a dedicated control unit.

5. A light set as in claim 1, wherein the case is configured to house the programmable controller and the interface, and the case has an arcuate edge, and the LED extends forwardly of the arcuate edge, and wherein the case is configured to fit within a fingertip of a glove so that the arcuate edge is at or adjacent a closed tip of the glove fingertip.

6. A programmable microlight for use in gloves for gloving, comprising:

a circuit board sized and configured to fit within a finger of a glove;

a multicolor light emitting diode (LED) on the circuit board;

a programmable controller on the circuit board, the programmable controller storing logic for controlling the functionality of the LED according to at least a first and a second operating mode, wherein in the first operating mode the programmable controller controls the LED to display a first light output pattern and in the second operating mode the programmable controller controls the LED to display a second light output pattern;

a control button on the circuit board, the control button configured to enable a user to select the first operating mode or the second operating mode; and an interface on the circuit board and communicating with the programmable controller, the interface configured to provide access for modifying or replacing at least a portion of the logic stored in the programmable controller;

wherein the interface is configured to connect the programmable controller to an external computer system.

7. A programmable microlight as in claim 6 additionally comprising a case, the circuit board being enclosed within the case, the case sized and configured to fit within the finger of a glove.

8. A programmable microlight as in claim 7, wherein a front edge of the case is arcuate, and the LED extends forwardly of the front edge of the case.

9. A programmable microlight as in claim 8, wherein the circuit board has a front edge and a back edge, and the LED is positioned on the circuit board so as to extend forwardly of the front edge.

10. A programmable microlight as in claim 9, wherein the interface comprises a wireless interface, and wherein the control button is positioned on the circuit board between the programmable controller and the interface.

11. A programmable microlight as in claim 6, wherein the circuit board has a front edge and a back edge, and the LED is positioned on the circuit board so as to extend forwardly of the front edge.

12. A programmable microlight as in claim 11, wherein the interface comprises a USB interface, and wherein the USB interface is positioned on the circuit board so that an opening of the USB interface is positioned to accept a USB cable connector moving in a direction generally parallel to the circuit board.

13. A programmable microlight as in claim 12, wherein the USB interface is positioned on the circuit board at or adjacent the back edge of the circuit board.

14. A programmable microlight as in claim 13, wherein the opening of the USB interface is directed toward the back edge of the circuit board, and wherein the control button is positioned on the circuit board between the programmable controller and the USB interface.

15. A programmable microlight as in claim 14 additionally comprising a case, the circuit board being enclosed within the case, the case sized and configured to fit within the finger of a glove.

16. A programmable microlight as in claim 15, wherein a front edge of the case is arcuate, and the LED extends forwardly of the front edge of the case.

17. A programmable microlight as in claim 6, wherein the external computer system is configured so that a user can select a third operating mode having a third light output pattern, and the computer system can transfer logic for driving the LED according to the selected third operating mode to the programmable controller through the interface.

18. A programmable microlight as in claim 17, wherein the computer system comprises an online repository of logic for driving the LED.

19. A programmable microlight as in claim 6, wherein the external computer system is configured so that a user can create a color output pattern, and the external computer system is configured to generate a custom logic for driving the LED in accordance with the user-created color output pattern, the interface is configured to deliver the custom logic to the programmable controller.

20. A programmable microlight as in claim 6, wherein the programmable controller is configured to receive, store and execute an additional logic from the external computer system, the additional logic corresponding to a third operating mode in which the LED displays a third light output pattern.

21. A programmable microlight as in claim 20, wherein the programmable controller is configured to replace the second operating mode with the third operating mode.

22. A programmable microlight as in claim 20, wherein the programmable controller is configured to store logic for each of the first, second and third operating modes.

23. A programmable microlight as in claim 20, wherein the circuit board has a front edge and a back edge, and the LED is positioned on the circuit board so as to extend forwardly of the front edge, and wherein the control button is positioned on the circuit board between the programmable controller and the interface.

24. A programmable microlight as in claim 23 additionally comprising a case, the circuit board being enclosed within the case, the case sized and configured to fit within the finger of a glove, and wherein a front edge of the case is arcuate, and the LED extends forwardly of the front edge of the case.

25. A programmable microlight as in claim 24, wherein the interface comprises a wireless interface.

26. A programmable microlight as in claim 24, wherein the interface comprises a USB interface.

27. A method of customizing and performing a gloving lightshow, comprising:

accessing a computer system, the computer system comprising logic for controlling a multicolor light emitting diode (LED) according to a plurality of operating modes;

selecting a first operating mode of the plurality of operating modes, the first operating mode corresponding to a first light output pattern;

connecting the computer system to a programmable microlight, the programmable microlight comprising a circuit board having an LED, a programmable chip configured to control the LED, a control button, and an interface, the computer system connecting to the programmable microlight through the interface, the programmable microlight sized and configured to fit within a finger of a glove;

directing transmission of a first logic corresponding to the first operating mode from the computer system to the programmable chip via the interface so that the first logic is stored by the programmable chip;

placing the programmable microlight within the fingertip of a glove;

placing the glove on a hand; and moving the hand and glove with the beat of music to perform a gloving lightshow.

28. A method as in claim 27 additionally comprising creating the first light output pattern using the computer system and directing the computer system to create the first logic.

29. A method as in claim 28, wherein creating the first light output pattern comprises defining one or more desired colors using the computer system.

30. A method as in claim 27 additionally comprising browsing a plurality of light output patterns displayed by the computer system, and selecting the first operating mode comprises selecting one of the plurality of light output patterns.

31. A method as in claim 30, wherein the computer system comprises an online repository of logic for driving the LED.

32. A method as in claim 27, wherein the first logic replaces a second logic stored in the programmable chip.

33. A method as in claim 27, wherein the first logic is added to a second logic stored in the programmable chip, the second logic corresponding to a second operating mode.

34. A method as in claim 33, wherein the programmable microlight comprises a case having a front edge, and the LED extends forwardly of the front edge of the case, and additionally comprising placing the programmable microlight so that the LED is directed toward the fingertip of the glove, and additionally comprising actuating the control button to switch from the first operating mode to a second operating mode.

* * * * *